United States Patent [19]

Grim

[11] Patent Number: 4,672,388

[45] Date of Patent: Jun. 9, 1987

[54] POLARIZED SIGNAL RECEIVER WAVEGUIDES AND PROBE

[76] Inventor: Fay Grim, 565 Newberg NE, Port Charlotte, Fla. 33952

[21] Appl. No.: 820,721

[22] Filed: Jan. 21, 1986

Related U.S. Application Data

[63] Continuation-in-part of Ser. No. 796,284, Nov. 8, 1985, which is a continuation-in-part of Ser. No. 621,119, Jun. 15, 1984, Pat. No. 4,554,553.

[51] Int. Cl.[4] ..... H01Q 13/02

[52] U.S. Cl. ..... 343/786; 333/21 A; 333/21 R

[58] Field of Search ..... 343/772, 786; 333/21 A, 333/21 R

[56] References Cited

U.S. PATENT DOCUMENTS 2,880,399 3/1959 Murphy ..... 333/21 R
4,504,836 3/1985 Seavey ..... 343/786

*Primary Examiner*—Eli Lieberman
*Assistant Examiner*—D. Johnson
*Attorney, Agent, or Firm*—Gifford, Groh, VanOphem, Sheridan, Sprinkle and Dolgorukov

[57] ABSTRACT

A polarized signal receiver waveguide assembly, or feedhorn, for receiving a selected one of linearly polarized electromagnetic signals in one waveguide of circular cross-section and for launching or transmitting the selected signal into a second waveguide, the axes of the waveguides being disposed at a right angle. The first waveguide has a closed end wall, formed as a hemispherical cavity having a hemispherical concave surface. A probe comprising a signal receiver portion disposed in a plane perpendicular to the axis of the first waveguide and a launch or transmitter portion having its axis perpendicular to the axis of the second waveguide has its launch or transmitter portion mounted in a controllably rotatable dielectric rod, such that rotation of the rod causes rotation of the signal receiver portion for alignment with a selected one of the polarized signals. The transmission line between the probe signal receiver portion and launch or transmitter portion consists of a single curvilinear conductor extending over a ninety degree arc parallel to and in close proximity to the hemispherical concave surface of the first waveguide end wall, or, alternatively, of a pair of bifurcated curvilinear branches forming a one-hundred eighty degree arc disposed along the axis of the first waveguide in close proximity to and parallel to the end wall hemispherical surface. The two waveguides are cast as a single-piece.

16 Claims, 8 Drawing Figures

FIG. 3
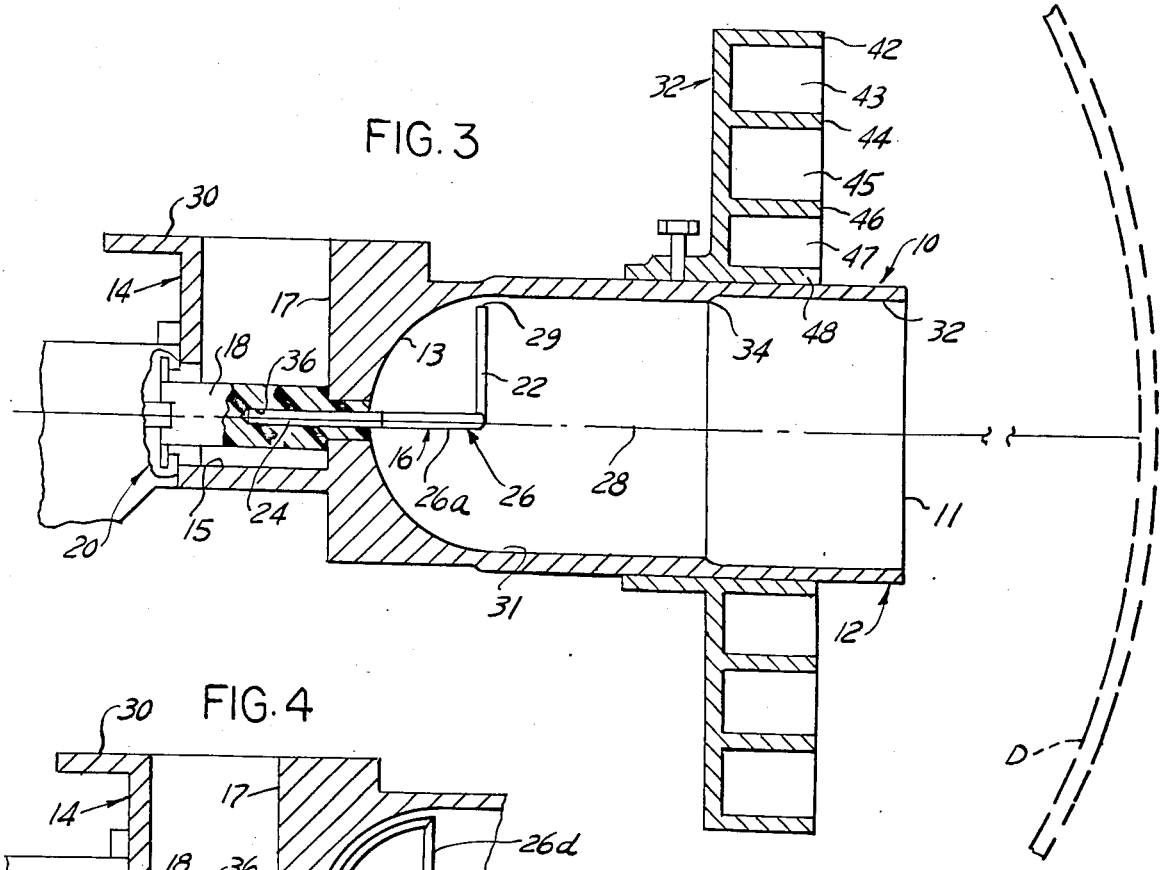
FIG. 4
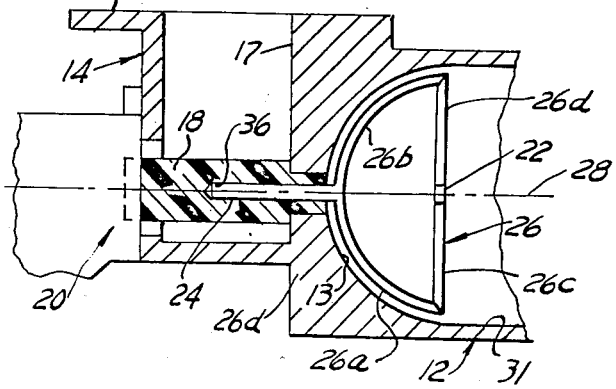
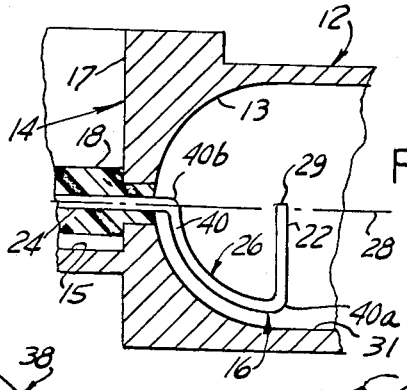
FIG.6
FIG.8
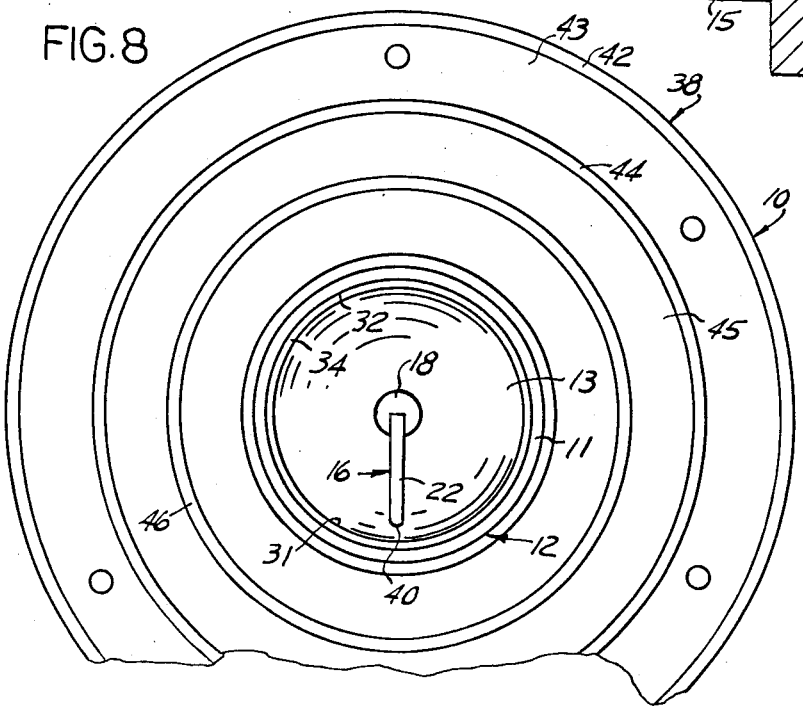
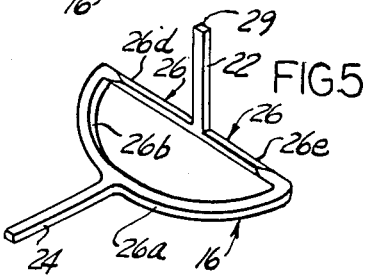
FIG5
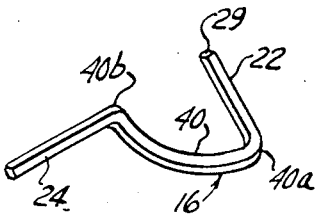
FIG.7

POLARIZED SIGNAL RECEIVER WAVEGUIDES AND PROBE

CROSS REFERENCE TO RELATED APPLICATIONS

The present application is a continuation-in-part of application Ser. No. 796,284, filed Nov. 8, 1985 for Polarized Signal Receiver Waveguides, which is a continuation-in-part of application Ser. No. 621,119, filed June 15, 1984 for Polarized Signal Receiver Probe, now Letters U.S. Pat. No. 4,554,553, issued Nov. 19, 1984.

BACKGROUND OF THE INVENTION

The present invention relates to polarized signal receiver waveguides in general, or so-called "feedhorns", as used in dish antennas for TVRO (television receive only) systems, and more particularly to a novel single-piece polarized signal receiving and signal transmitting waveguide and novel receiver probe.

The RF signals transmitted by communication satellite transponders consist of two linearly polarized signals, rotated 90° from each other. The linearly polarized signals reflected by the dish are received through the open end of a feedhorn, installed at the focus of the dish and comprising a cylindrical waveguide of circular cross section. Only one of the two polarized signals is received, the other signal being reflected out of the feedhorn. The detected signal is fed through a second waveguide, generally a waveguide having a rectangular cross-section, whose axis is conventionally disposed at 90° to the axis of the feedhorn waveguide, and which feeds the detected signal to a low-noise amplifier (LNA).

Various antenna probe arrangement may be used for receiving one of the polarized signals in the feedhorn circular waveguide and for launching, or retransmitting, the detected signal into the rectangular waveguide. Generally, the antenna probe comprises a receiver portion disposed in the circular waveguide, and a signal launch or transmitter portion disposed in the rectangular waveguide, the probe being supported by a rotatable dielectric rod driven by a servomotor mounted on the waveguide assembly. The launch or transmitter portion of the probe has its axis aligned with the axis of the circular waveguide and with the axis of the dielectric rod, such as to remain constantly perpendicular to the axis of the rectangular waveguide during rotation of the probe. The probe receiver portion has its longitudinal axis perpendicular to the axis of rotation such as to rotate between the two orthogonally polarized signals in the circular waveguide. By rotation to a desired position, one polarized signal is received and the other is reflected. The received signal is conducted by the transmission line portion of the probe through the rear wall of the circular waveguide and is launched or retransmitted into the rectangular waveguide by the probe launch or transmitter portion.

The circular waveguide and the rectangular waveguide are conventionally made of separate elements, usually separate castings of, preferably, aluminum alloy. The two castings are assembled together, usually by providing one of the waveguides, for example the rectangular waveguide, with a flange which is bolted to the rear end of the circular waveguide, the rectangular waveguide being provided with a circular recess in which projects a correspondingly cylindrical end portion of the circular waveguide. Such an assembly is relatively fragile, causes power losses and the introduction of noise in the signal received in the circular waveguide and launched or retransmitted in the rectangular waveguide.

As the waveguide assembly is installed in an outdoor TVRO dish antenna, the assembly is exposed to inclement weather, such as rain or snow, dust and high wind, and to atmospheric pollution, all adverse conditions that may cause rapid deterioration, corrosion of the metallic surfaces and loosening of the joint between the waveguides. There results further deterioration of the relatively low level ultra-high frequency signals captured by the antenna system.

The invention disclosed in co-pending application Ser. No. 796,284 is an improvement upon the prior art polarized signal feedhorn waveguides and probes which provides a microwave polarized signal receiver and transmission system in the form of a single-piece waveguide structure having a rotatable probe for receiving an appropriate one of two linearly polarized signals, fed into a first waveguide, and for transmitting the selected one of the signals to a second waveguide disposed perpendicularly to and cast integrally with the first waveguide, and for launching or retransmitting the selected signal in the second waveguide.

SUMMARY OF THE INVENTION

The present invention is an improvement of the Polarized Signal Receiver Waveguides disclosed in co-pending application Ser. No. 796,284. The present invention also provides a single-piece waveguide assembly, but having a hemispherical concave rear end wall for the circularly cylindrical waveguide and a rotatable probe provided with a transmission line between the receiver portion of the probe and the launching or retransmitting portion of the probe which is contoured to the hemispherical shape of the wall.

The present invention, due to its particular waveguide and receiver probe structures, provides a substantial improvement in strength and rigidity of the waveguide assembly, in the amplitude of the signal transferred from one waveguide to the other, a reduction of parasitical capacitance during transfer of signals from one waveguide to the other, and an increase in the signal-to-noise ratio and in the rejection of unwanted signals, as compared to polarized signal receiver, transmission and launch systems heretofore available.

A better understanding of the present invention and of its many objects and advantages will be obtained by those skilled in the art from the following description of the best mode contemplated for practicing the invention, when read in conjunction with the accompanying drawing wherein:

BRIEF DESCRIPTION OF THE DRAWING

FIG. 3 is a longitudinal sectional view thereof along line 3—3 of FIG. 2;

FIG. 4 is a partial view similar to FIG. 3 but showing the receiver probe rotated 90° from the position shown at FIG. 3;

FIG. 5 is a perspective view of the probe portion thereof;

FIG. 6 is a partial view similar to FIG. 3 but showing a modification of the probe portion thereof;

FIG. 7 is a perspective view of the probe portion of the structure of FIG. 6; and FIG. 8 is a front elevation view of a waveguide assembly provided with the probe of FIGS. 6 and 7.

DETAILED DESCRIPTION OF THE PREFERRED EMBODIMENTS

Figure 1:
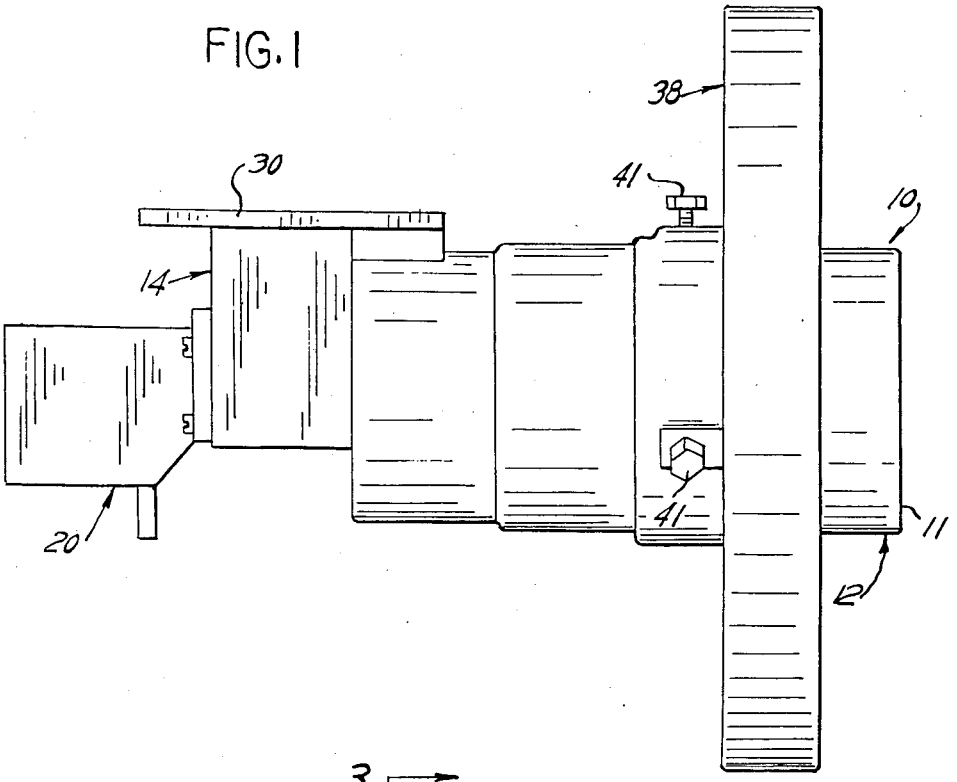
FIG. 1 is a side elevation view of a waveguide assembly according to the invention.
Figure 2:
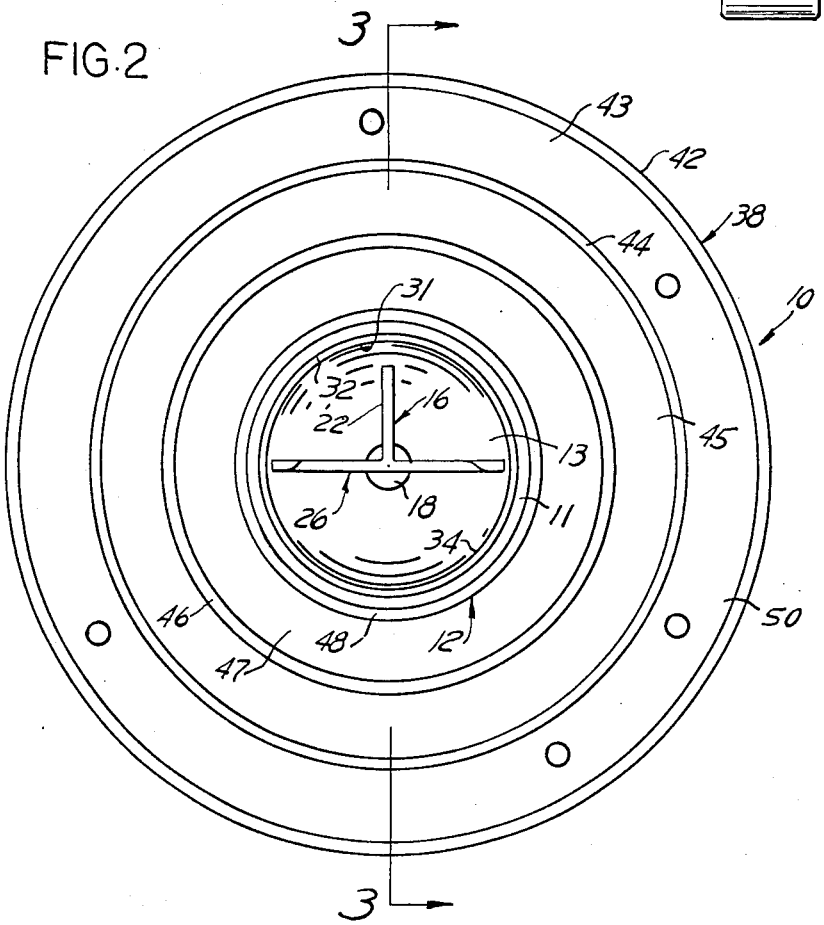
FIG. 2 is a front elevation view thereof.

Referring now to the drawing, and more particularly to FIGS. 1–3, there is illustrated a feedhorn 10 for reception of satellite transmitted television signals or other RF signals of ultra-high frequency, for example in the 3.7 to 4.2 GHz range, as presently used. The feedhorn 10 is generally used installed at the focus of a parabolic reflector dish, shown schematically at D at FIG. 3, such that the RF microwaves are reflected into the open end 11 of the feedhorn 10.

The feedhorn 10 is made principally of a pair of waveguides 12 and 14, cast integrally of metal or metal alloy such as, for example, aluminum alloy. The waveguide 12 is a circular waveguide, i.e. circular in cross-section, while the waveguide 14 is a rectangular waveguide, i.e. rectangular in cross-section.

The circular waveguide 12 has a substantially hemispherical concave integral rear wall 13 and is disposed with its longitudinal axis at right angle to the longitudinal axis of the rectangular waveguide 14 formed integrally at the closed end, or hemispherical concave rear wall 13, of the circular waveguide 12. The rectangular waveguide 14 is closed at one end by an end or rear wall 15 and is coupled at its open end to a low-noise signal amplifier (LNA), not shown. A probe 16 is fixedly mounted coaxially in a dielectric rod or shaft 18 disposed rotatably through the hemispherical concave rear wall 13 of the circular waveguide 12 which is integral with a corresponding sidewall 17 of the rectangular waveguide 14. The dielectric rod or shaft 18 and the probe 16 are driven in rotation by a servomotor 20.

The probe 16 is made of a single continuous electrical conductor and, preferably, of a single-piece precision casting or stamping of electrically conductive metal or alloy. The probe 16 comprises a receiver portion 22, approximately one-quarter wavelength long, having its longitudinal axis disposed in a plane perpendicular to the longitudinal axis 28 of the circular waveguide 12, and a signal launch, or transmitter, portion 24 held within the dielectric rod 18 with its longitudinal axis aligned with the longitudinal axis, or axis of symmetry, 28 of the circular waveguide 12. The probe signal launch or transmitter portion 24 projects within the rectangular waveguide 14, perpendicularly to the longitudinal axis of the waveguide 14. The probe signal receiver portion 22 and signal launch or transmitter portion 24 are integrally connected by a transmission line portion 26. The transmission line portion 26 is formed of two symmetrically disposed curvilinear branches **26*a* and 26*b* each extending over an arc of a circle of 90°, and of two symmetrically disposed straight portions 26*c* and 26*d* integrally attached to the end of the curvilinear portions 26*a* and 26*b* at one end and to the probe signal receiver portion 22 at the other end. In other words, the curvilinear portions 26*a* and 26*b* of the transmission line portion 26 form a substantially semi-circular, or 180° arc portion attached integrally at its center to the launch or transmitter portion 24 of the probe 16 projecting within the rectangular waveguide 14, the straight portions 26*c* and 26*d* of the transmission line 26 extending substantially along a diameter of the circular waveguide 12, while the receiver probe portion 22 projects from substantially the middle of the straight branches 26*c* and 26*d*, orthogonal to the axis 28 of symmetry of the circular waveguide 12 and, consequently, also orthogonal to the axis of rotation of the probe 16. The tip 29 of the receiver probe portion 22 is substantially adjacent to the cylindrical inner wall 31 of the circular waveguide 12, substantially at the intersection of the cylindrical wall with the hemispherical concave rear wall 13**.

Equality of the lengths of the transmission line branches **26*a* and 26*b* and 26*c* and 26*d* is critical for minimizing signal strength losses between the probe signal receiver portion 22 and the probe signal launch or transmitter portion 24. Accurate fabrication of the probe 16, such as by precision casting or stamping, results in providing equal length branches 26*a* and 26*b*, and 26*c* and 26*d*, for the transmission line 26, and in providing accurate one-quarter wavelength for the probe signal receiver portion 22**, for better rejection of unwanted signals, and improved signal-to-noise ratio performance.

Typically, the probe 16 is economically made of an aluminum alloy stamping, with the probe signal receiver portion 22 originally disposed in the same plane as that of the transmission line 26 and subsequently bent over by twisting the branches **26*d* and 26*c* for disposing the probe signal receiver portion 22 substantially at a right angle to the plane of the transmission line 26**.

The particular configuration of the probe transmission line 26 between the probe signal receiver portion 22 and signal launch or transmitter portion 24 results in a practically capacitanceless transmission line, and in good impedance match between the two integral waveguides 12 and 14. The length of the portions **26*c* and 26*d* of each branch, perpendicular to the axis 28 of the circular waveguide 12, is preferably one-quarter of a wavelength. The arcuate portions 26*a* and 26*b* are parallel to the hemispherical concave rear wall 13 of the waveguide 12, and about 2 to 4 mm. away from the surface of the rear wall 13. The length of the probe launch or transmitter portion 24 is not critical, as long as the probe launch or transmitter portion 24 extends sufficiently into the rectangular waveguide 14 beyond the hemispherical concave end wall 13 of the circular waveguide 12. Typically, and only for the sake of convenience, the length of the launch probe portion 24 extending into the rectangular waveguide 14** is approximately 1/6 of the wavelength.

In operation, the probe 16, FIGS. 3–4, is rotatively driven, from a remote control location, by way of the servomotor 20 rotating the dielectric rod or shaft 18, thus causing the probe signal receiver portion 22 to sweep a substantially circular plane in the circular waveguide 12, perpendicular to the axis 28. As the probe signal receiver portion 22 aligns itself with the desired linearly polarized signal in the circular waveguide 12, the detected signal is transmitted through the bifurcated transmission line 26 to the probe signal launch or transmitter portion 24 projecting in the rectangular waveguide 14. The desired orientation of the probe signal receiver portion 22 is determined by a peak in the detected signal. The signal launched in the rectangular waveguide 14 by the probe signal launch or transmitter portion 24 is evidently unaffected by the rotation of the probe 16, because the probe signal launch or transmitter portion 24 rotates around the axis of symmetry 28 of the circular waveguide 12.

FIGS. 6–8 illustrate an identical feedhorn comprising a cylindrical or circular waveguide 12 integrally formed with a rectangular waveguide 14 in a single casting. The circular waveguide 12 has an integrally formed substantially hemispherical concave rear wall 13, and a probe 16 comprising a receiver portion 22 and a launch or transmitter portion 24 is held in the dielectric rod 18 rotated by the servomotor, as hereinbefore explained. The probe 16 has a transmission line 26 connecting the receiver probe portion 22 to the launch or transmitter portion 24 via a single integral conductor 40 which is shaped as an arc of a circle extending over an arc of substantially 90°, having an end 40*a* integrally joined to the receiver probe portion 22 and another end 40*b* integrally joined to the launch or transmitter probe portion 24 extending into the rectangular waveguide 14 perpendicular to the longitudinal axis thereof. The transmission line 26 formed by the single filament 40 has therefore a shape following the concave contour of the hemispherical concave end wall 24 of the circular waveguide 12. The receiver portion 22 of the probe 16 of FIGS. 6–8 has its tip 29 disposed substantially at the longitudinal axis or axis 28 of symmetry of the circular waveguide 12 and consequently substantially along the axis of rotation of the launch or transmitter portion 24 of the probe. The receiver portion 22 of the probe extend orthogonally to the axes 28 of symmetry of the circular waveguide 12 which coincides with the axis of rotation of the probe 16.

For some applications, it may be desirable to bend the receiver portion 22 of the probe 16, of FIGS. 3–5 as well as of FIGS. 4–7, at an angle other than 90° to the axis 28 of symmetry of the circular waveguide 12 to favor reception of microwaves at one end or the other of the range of frequency for which the microwave waveguide and probe assembly is designed.

Referring back to FIGS. 1–4 and 6, it is clear that one aspect of the invention is to mold the circular waveguide 12 as a single-piece with the rectangular waveguide 14, and to form the end wall 13 of the circular waveguide 12 integrally not only as a portion of the sidewall 17 of the rectangular waveguide 14, but as a substantially hemispherical cavity, FIGS. 3, 4 and 6, rather than as a flat surface end wall as in the prior art. There is no requirement to mechanically couple, by means of fasteners, the circular waveguide 12 and the rectangular waveguide 14, thus providing a single-piece feedhorn unit at a relatively low cost, as compared to a two-piece assembly. In addition, the hemispherical concave end wall 13 results in a substantial increase in wall thickness at the junction between the waveguides 12 and 14 which greatly contributes to improving the mechanical strength and rigidity of the assembly.

Another aspect of the present invention is to shape the transmission line portion 26 of the probe 16, the bifurcated transmission line portion 26 of FIGS. 3–5 as well as the single strand transmission line portion 40 of FIGS. 6–7, curved such as to conform to the concave hemispherical surface of the circular waveguide hemispherical end wall 13, the exterior surface of the transmission line portion 26*a* and 26*b*, FIGS. 3 and 4, or 40, FIG. 6, remains at a substantially constant distance from the hemispherical surface of the end wall 13 during rotation of the probe about its axis of rotation 28.

The rectangular waveguide 14 is provided at its open end with a flange 30 for coupling to an appropriate input waveguide of the LNA. The circular waveguide 12 is provided at its open end 11 with an internally enlarged diameter portion 32 forming a shoulder 34 at the junction between the internal cylindrical surface 31 of the circular waveguide 12 and the internal surface of its enlarged diameter portion 32. The step or shoulder 34 acts as a reference shoulder for an appropriate depth gauge, not shown, for exact location, during assembly, of the probe 16 into the dielectric rod 18 for determining the longitudinal positioning of the probe receiver portion 22 in the circular waveguide 12. The probe 16 is attached to the dielectric rod or shaft 18 as a result of the probe launch or transmitter portion 24 being cemented in an axially disposed central bore 36, FIG. 3, in the dielectric rod 18.

The feedhorn 10 is provided with an adjustable "scaler" ring 38 which may be longitudinally positioned where most effective along the circular waveguide 12 and held in position by tightening the setscrews or bolts 41. As is known in the art, a scaler ring structure such as the illustrated structure provided with as plurality of concentric rings, 42, 44 and 46, forming concentric channels 43, 45 and 47 between the rings and a bottom flat circular plate 50, produces out of phase coupling of the principal receiving aperture or open end 11 of the circular waveguide 12, as explained in detail, for example, in U.S. Pat. No. 4,168,504, for Multi-Mode Dual Frequency Antenna Feed Horn.

The longitudinal positioning of the scaler ring 38 is dependent upon the f/D ratio of the dish in which the feedhorn 10 is installed, f being the focal length of the dish and D the diameter of the dish. Normally, and for best performance, the feedhorn 10 is suspended over the center of the dish with the centerline of the dish coinciding with the centerline 28 of the circular waveguide 12. The focal point of the dish is situated within the circular waveguide 12 6.5 mm from the edge of the waveguide open end 11. For a dish having an f/D ratio of 0.42 the leading edge of the scaler ring 38 is positioned flush with the leading edge of the circular waveguide 12. The scaler ring offset distance from the leading edge of the circular waveguide 12 as a function of the dish f/D ratio is a linear function, such that for a dish f/D ratio of 0.4, the offset is 5 mm, for a dish f/D ratio of 0.38 the offset is 10 mm, for a f/D ratio of 0.36, the offset is 15 mm, for an f/D ratio of 0.34, the offset is 20 mm, for a f/D ratio of 0.32, the offset is 25 mm, etc. The numerical example hereinbefore given are particularly suitable for operation in the frequency range of 3.7–4.2 GHz, conventionally in use at the present, and for the future K-band at which projected TVRO systems will operate.

Having thus described the present invention by way of examples of structures well designed for accomplishing the objects of the invention, modifications thereof will be apparent to those skilled in the art, what is claimed as new is as follows:

1. In a polarized signal receiver comprising a first waveguide of circular cross-section for receiving polarized signals at one open end, said first waveguide having a rear wall, a second waveguide for transmitting polarized signals, a dielectric rod controllably rotatably mounted axially through the rear wall of said first waveguide, means for controllably rotating said dielectric rod and a signal transferring probe mounted in said dielectric rod concentric with the axis of rotation thereof, said signal transferring probe comprising a receiver portion disposed in said first waveguide in a plane orthogonal to the axis of said first waveguide for receiving one of the polarized signals in said first waveguide, a launch or transmitter portion extending into the second waveguide substantially perpendicular to the axis of said second waveguide, said launch or transmitter portion being disposed concentric with said dielectric rod and rotatable in unison with said dielectric rod, and a transmission line portion connecting said receiver portion to said launch or transmitter portion, the improvement comprising said first and second waveguides being a single-piece metallic casting, and said rear wall of said first waveguide being formed as a substantially hemispherical cavity having a substantially hemispherical concave surface.

2. The improvement of claim 1 wherein said rear wall of said first waveguide is integral with a lateral wall of said first waveguide.

3. The improvement of claim 1 wherein said second waveguide is of rectangular cross-section.

4. The improvement of claim 2 wherein said second waveguide is of rectangular cross-section.

5. The improvement of claim 1 further comprising said transmission line portion being curvilinear and extending substantially over a 90° arc in close proximity to said hemispherical concave surface.

6. The improvement of claim 2 further comprising said transmission line portion being curvilinear and extending substantially over a 90° arc in close proximity to said hemispherical concave surface.

7. The improvement of claim 3 further comprising said transmission line portion being curvilinear and extending substantially over a 90° arc in close proximity to said hemispherical concave surface.

8. The improvement of claim 4 further comprising said transmission line portion being curvilinear and extending substantially over a 90° arc in close proximity to said hemispherical concave surface.

9. The improvement of claim 1 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

10. The improvement of claim 2 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

11. The improvement of claim 3 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

12. The improvement of claim 4 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

13. The improvement of claim 5 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

14. The improvement of claim 6 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

15. The improvement of claim 7 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

16. The improvement of claim 8 further comprising said transmission line portion having a pair of curvilinear branch portions each extending over an arc of substantially 90° in close proximity with said hemispherical concave surface, each of said curvilinear branch portions being attached at an end integrally to said launch or transmitter portion and being attached at another end integrally to an end of a straight portion extending diametrically transversely in said first waveguide, said receiver probe portion being integrally attached to said straight portion substantially at the middle thereof and having a tip disposed proximate the internal surface of said first waveguide.

* * * * *